US005862445A

United States Patent [19]

Ogawa et al.

[11] Patent Number: 5,862,445

[45] **Date of Patent: *Jan. 19, 1999**

[54] IMAGE HEATING APPARATUS USING INDUCTIVE HEATING

[75] Inventors: Kenichi Ogawa; Yasumasa Ohtsuka, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 551,646

[22] Filed: Nov. 1, 1995

[30] Foreign Application Priority Data

Nov. 1, 1994 [JP] Japan ..... 6-292118

[51] Int. Cl.[6] ..... G03G 15/20

[52] U.S. Cl. ..... 399/329; 399/331; 219/216; 219/619

[58] Field of Search ..... 355/282, 285, 355/289, 290, 286; 219/216, 469, 388, 645; 399/328, 329, 331

[56] References Cited

U.S. PATENT DOCUMENTS

| | | | |
|---|---|---|---|
| 4,570,044 | 2/1986 | Kobayashi et al. | 219/216 X |
| 5,177,549 | 1/1993 | Ohtsuka et al. . | |
| 5,250,998 | 10/1993 | Ueda et al. | 399/329 |
| 5,278,618 | 1/1994 | Mitani et al. | 355/285 |
| 5,331,385 | 7/1994 | Ohtsuka et al. . | |
| 5,526,103 | 6/1996 | Kato et al. | 355/285 |
| 5,552,582 | 9/1996 | Abe et al. | 219/619 |
| 5,568,240 | 10/1996 | Ohtsuka | 399/335 |

FOREIGN PATENT DOCUMENTS

| | | |
|---|---|---|
| 60-069674 | 4/1985 | Japan . |
| 5-9027 | 2/1993 | Japan . |

*Primary Examiner*—Robert Beatty

*Attorney, Agent, or Firm*—Fitzpatrick, Cella, Harper & Scinto

[57] ABSTRACT

An image heating apparatus includes a movable member having an electroconductive portion; a back-up member for forming a nip with the movable member; wherein the back-up member has an electroconductive portion-adjacent a surface thereof; magnetic flux producing device for generating a magnetic flux; wherein eddy current is generated in the movable member and the back-up member by a magnetic flux generated by the magnetic flux generating device, and the movable member and the back-up member generate heat by the eddy current.

32 Claims, 6 Drawing Sheets

IMAGE HEATING APPARATUS USING INDUCTIVE HEATING

FIELD OF THE INVENTION AND RELATED ART

The present invention relates to an image heating device wherein eddy currant is generated in an electroconductive member using electromagnetic (magnetic) induction to generate heat which is used to heat toner image.

Recently, as disclosed in Japanese Patent Application Publication No. HEI-5-9027, a heating device has been proposed wherein eddy current is produced in a fixing roller of ferromagnetic material by magnetic flux, so that the heat is generated in the fixing roller by joule heat (electromagnetic induction heating type).

The use of the production of the eddy current is effective to make the heat generation position closer to the toner so that the efficiency improvement of the consumption energy is accomplished as compared with a heat roller type using a halogen lamp.

Particularly in a color image forming apparatus, the unfixed toner image on the recording material is of 3 layer or more layer of color toner materials. Therefore, fixing property defect occurs unless the toner is heated to the interface with the recording material. Additionally, the glossiness of the image changes depending on the degree of heating.

When, a color unfixed image is to be fixed, the height of the color toner is approx. 3 times the height of the toner in a monochromatic toner image.

It is desired in the fixing of the color image that the heating value in the nip is large. In the case of the heating device of the electromagnetic induction type, if an attempt is made to increase the amount of the eddy current for the purpose of increasing the joule heat, the excitation coil and the excitation iron core are overheated with the result of decreased amount of the magnetic flux and therefore unstable heat generation.

If use is made only with the heating from the fixing roller side, the toner is not easily fusing at the interface with the recording material, and therefore, the fixing property is deteriorated.

SUMMARY OF THE INVENTION

Accordingly, it is a principal object of the present invention to provide an image heating device wherein a heating value at the fixing nip is increased, so the fixing property is improved.

It is another object of the present invention to provide an image heating device wherein eddy current is produced in a movable member and a back-up member by the magnetic flux produced by magnetic flux producing means, and the heat is generated by the eddy current in the movable member and the back-up member.

It is a further object of the present invention to provide an image heating device wherein eddy current is produced in the back-up member for forming a nip in cooperation with a moving member moving with the unfixed toner image in contact therewith, by the magnetic flux producing by the magnetic flux producing means.

It is a further object of the present invention to provide an image heating device wherein an excitation coil is disposed across a movable member having an electroconductive portion from a back-up ember having an electroconductive portion, and the voltage applied the the excitation coil is controlled.

While the invention has been described with reference to the structures disclosed herein, it is not confined to the details set forth and this application is intended to cover such modifications or changes as may come within the purpose of the improvements or the scope of the following claim.

DESCRIPTION OF THE PREFERRED EMBODIMENT

Referring to the accompanied drawings, the embodiments of the present invention will be described.

Figure 1:
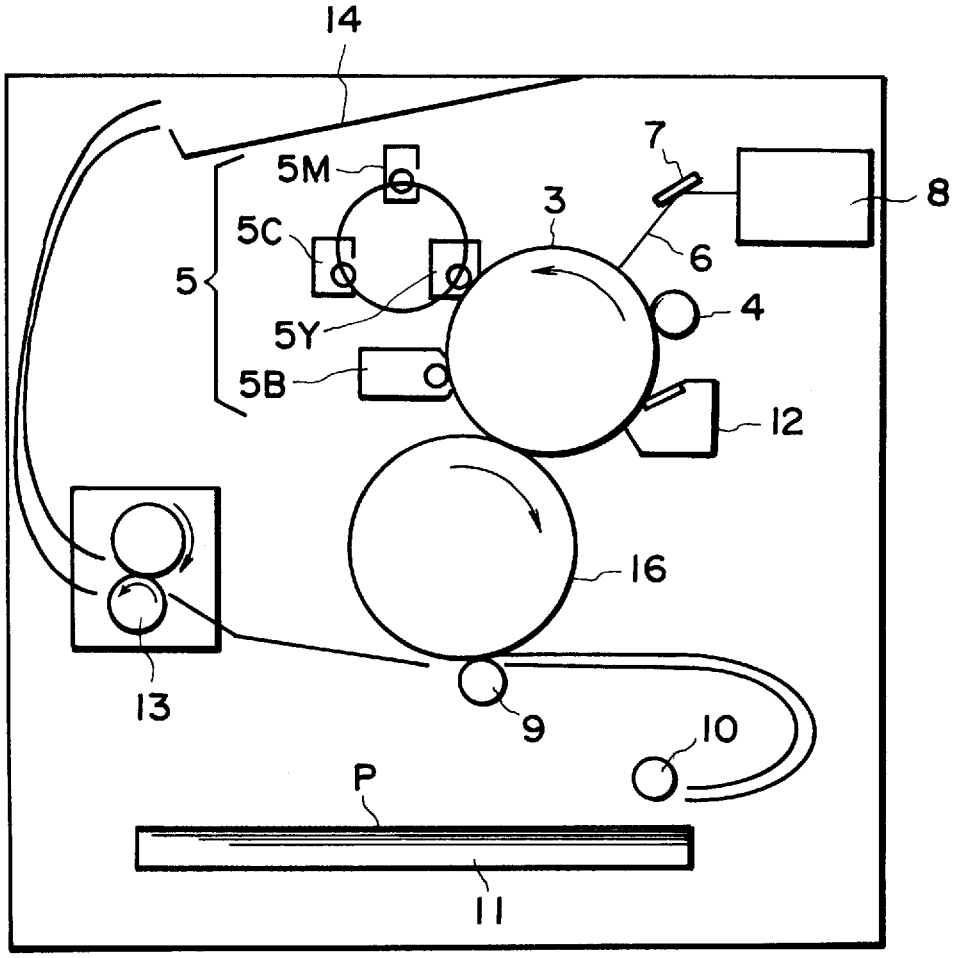
FIG. 1 is a schematic illustration of an image forming apparatus according to embodiment 1 of the present invention.

(1) Example of mate forming apparatus (FIG. 1)

FIG. 1 is a schematic illustration of an example of an image forming apparatus according to an embodiment of the present invention. The image forming apparatus of this embodiment is an electrophotographic color printer of a laser scanning type.

In the Figure, designated by 3 is a photosensitive drum of amorphous silicon photosensitive member or organic photosensitive member, and is rotated in the counterclockwise direction indicated by the arrow at a predetermined peripheral speed (process speed). The peripheral surface of the rotatable photosensitive drum 3 is uniformly charged to a predetermined polarity and potential by a charging roller 4. The thus charged surface of the photosensitive member 1 is exposed to and scanned by a laser beam having an intensity modulated (on/off)in accordance with time series electric digital pixel signal corresponding to the intended image information, so that an electrostatic latent image thereof is formed. The laser beam is projected from an unshown laser beam scanner including a laser diode, polygonal mirror or the like. Thus, an electrostatic latent image is formed. Designated by 7 is a laser light reflection mirror to deflect the output laser light 6 from the laser optical system casing 8 onto the photosensitive drum 3.

Designated by 5 is a developing device comprising a yellow toner developing device 5Y, a magenta toner developing device 5M, a cyan toner developing device 5C which are selectively usable, and a black toner developing device 5B for the black color.

Designated by 16 is an intermediate transfer drum. It is disposed in contact with or close to the photosensitive drum 3, and is rotated codirectionally with the photosensitive drum 3 (peripheral movement) substantially at the same peripheral speed as the photosensitive drum 3.

Formation of electrostatic latent image for each color separation image of an intended full-color image on the rotatable photosensitive drum 3, and the toner development of the electrostatic latent image with the corresponding color toner, are sequentially carried out, and the toner images are superposedly overlaid on the intermediated transfer drum 16, so that a full-color mirror image of the intended image is formed on the intermediate transfer drum 16. Designated by 12 is a cleaner for cleaning the surface of the photosensitive drum 3 after the toner image transfer onto the intermediate transfer drum 16.

A transfer material P as the recording material is fed one by one from the sheet feeding cassette 11 to the intermediate transfer drum 16, and the mirror full-color toner image is transferred from the intermediate transfer drum 16 onto the transfer material P so that the full-color toner image is formed on the surface of the transfer material P. The toner image is transferred onto the transfer material P from the intermediate transfer drum 16 by supplying the charge of the polarity opposite from that of the toner to the rear surface of the transfer material P.

The transfer material P having received the full-color toner image is separated from the intermediate transfer drum 16 and is introduced into fixing device 13 where the toner image is heated and fixed, and then is discharged into a sheet discharge tray 14.

Figure 2:
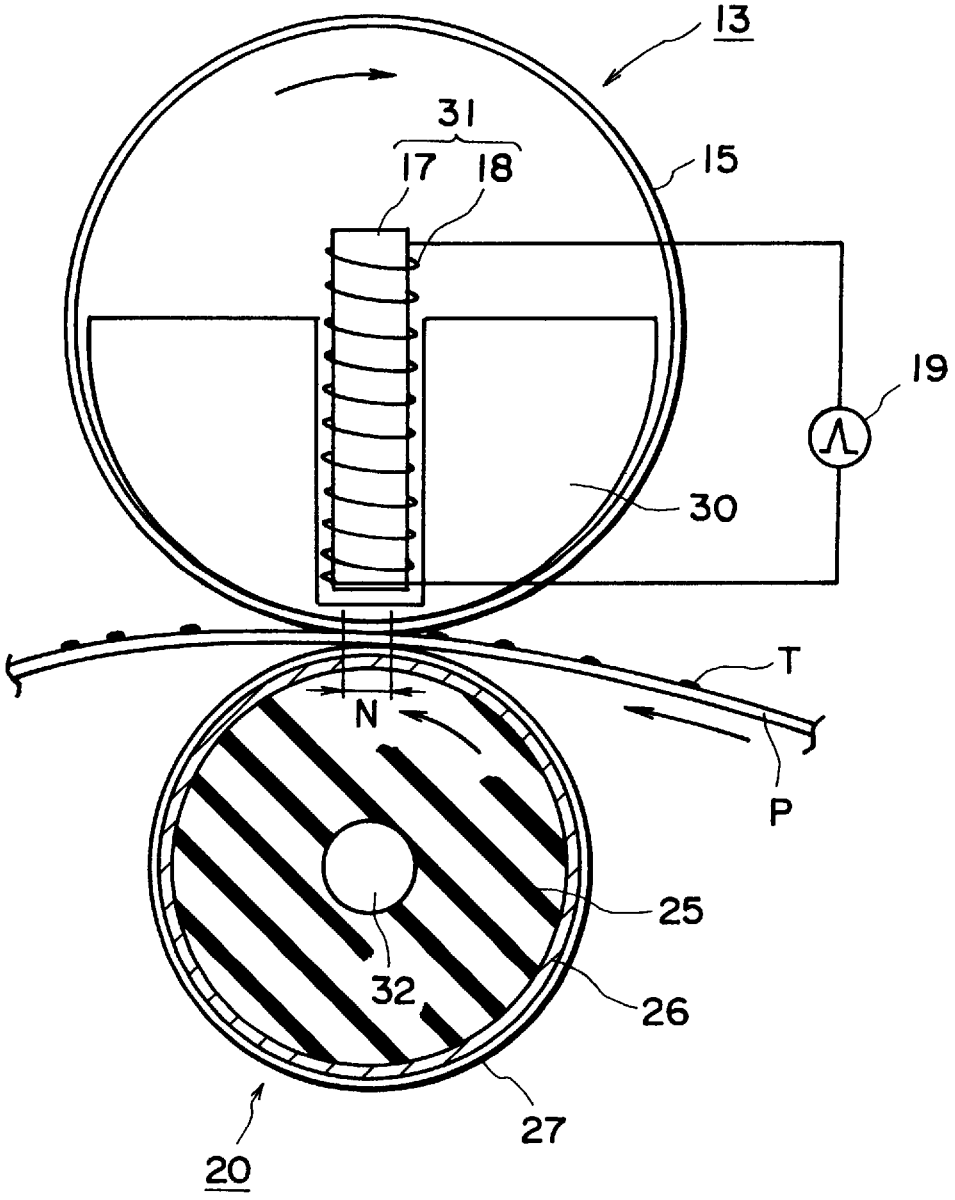
FIG. 2 is a schematic illustration of an image heat-fixing device.
Figure 3:
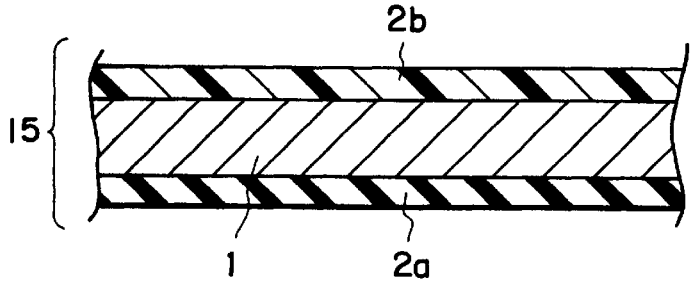
FIG. 3 is a layer structure schematic view of a fixing film.
Figure 4:
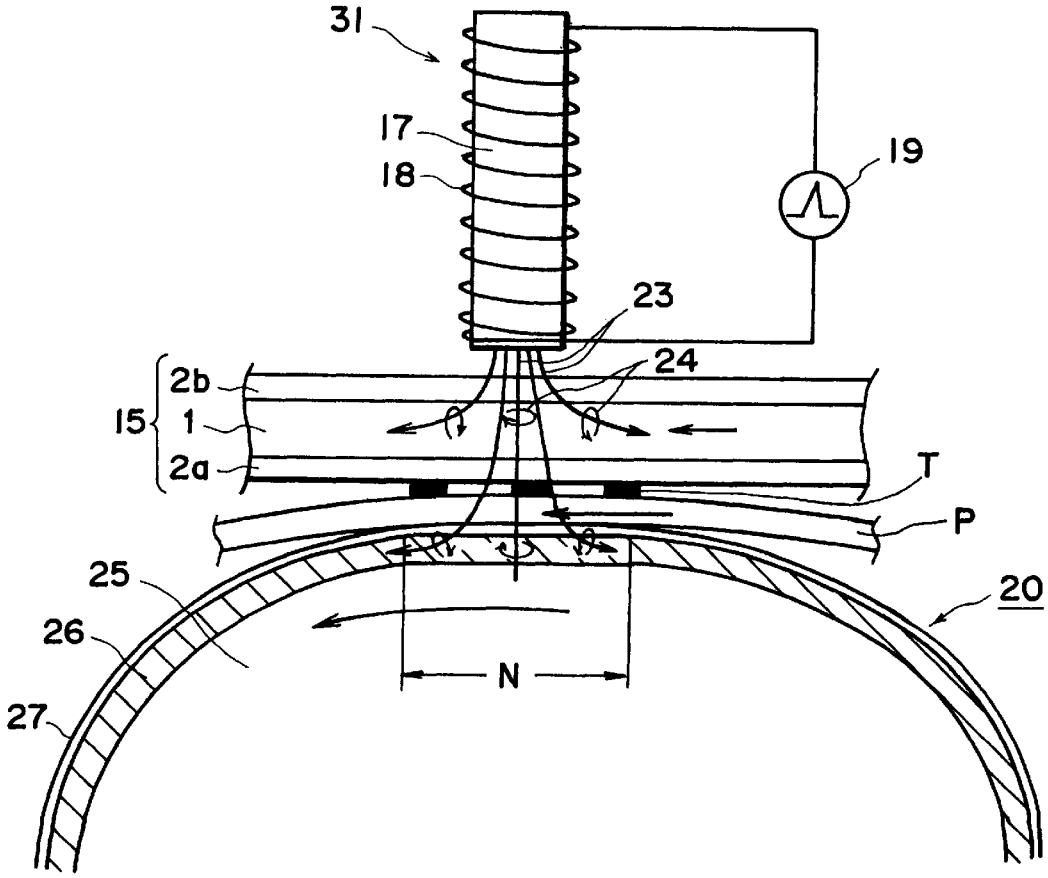
FIG. 4 is an illustration of principle of magnetic induction heating.

(2) Fixing device (FIG. 2–FIG. 4)

FIG. 2 is a schematic illustration of a fixing device 13 according to an embodiment of the present invention. It comprises a film having an electroconductive layer (heat generation layer), a pressing member having an electroconductive layer (heat generation layer) adjacent the surface thereof, and an alternating magnetic field producing means for generating heat by producing eddy current by imparting a magnetic field (magnetic flux) to the electroconductive layer, wherein the recording material is passed through a nip between the film and the pressing member to heat it.

Designated by 15 is a fixing film as a movable member having the electroconductive layer, which will be described hereinafter, and is in the form of a cylindrical (endless belt-like) film. The cylindrical film 15 is loosely extended around a semicircular film guide 30.

As will be described hereinafter, designated by 20 is a pressing roller functioning as a back-up member(pressing member) having an electroconductive layer, and is press-contacted at a predetermined pressing force by an unshown urging means to the bottom side of the film guide 30 with the film 15 therebetween.

Designated by N is a nip (fixing nip) formed by the bottom surface of the film guide 30 and the pressing roller 20 with the film 15 sandwiched therebetween.

Designated by 31 is an alternating magnetic field producing means (magnetic flux producing means) which comprises a high magnetic permeability core 17 and an excitation coil 18 therearound. It is supported on a film guide 30 at the central portion thereof so as to correspond closely to the fixing nip N. Designated by 19 is a magnetic circuit (excitation circuit) connected to the coil 18.

The pressing roller 20 is rotated at a predetermined speed in the counterclockwise direction indicated by the arrow. With the rotation of the pressing roller 20, the fixing film 15 is rotated around the film guide 30 in the clockwise direction indicated by the arrow by the frictional force between the pressing roller 20, while the internal surface thereof is sliding on the bottom surface of the film guide 30 in the fixing nip N. In this case, the film guide 30 functions to press to the fixing nip N and to stabilize the fixing film 15.

The transfer material P as the recording material is introduced to between the fixing film 15 and the pressing roller 20 in the fixing nip N, so that the transfer material P is fed through the fixing nip N with the film 15 while in close contact to the fixing film 15.

FIG. 3 is a layer structure schematic view of the fixing film 15. In the Figure, designated by 1 is an electroconductive layer of metal or the like film as a base layer of the fixing film 15. The metal is preferably a ferro-magnetic member Such as nickel, iron or stainless steel. Designated by **2*a* is a heat resistive resin material layer exhibiting a high parting property and heat-resistiveness and made of silicone resin material, fluorine resin material silicone rubber, fluorine rubber or the like, on the outer side of the electroconductive layer 1. Designated by 2*b* is a heat resistive resin material layer of fluorine resin material, polyimide resin material, polyamide resin material, PPS resin material, PEEK resin material, liquid crystal polymer, phenolic resin or the like, on the inner surface of the electroconductive layer 1**.

The pressing roller 20, as shown in FIG. 2, has an elastic layer 25 exhibiting a high heat-resistiveness of silicone rubber, fluorine rubber or the like around the core metal 32. Thereon, there is provided an electroconductive layer (heat generation layer) 26 of metal or the like having an electroconductivity and capable of producing the eddy current. The outermost layer is a resin material layer 27 of fluorine resin material, silicone resin material or the like having high heat-resistiveness and parting property.

The high magnetic permeability core 17 of the alternating magnetic field producing means 31 is of ferrite or permalloy or the like used core of a transformer. Preferably, from the standpoint of smaller loss in 100 kHz or higher, ferrite is preferable. An excitation circuit 19 generates by a switching voltage source a high frequency of 20 kHz to 500 kHz.

By production of the high frequency by the excitation circuit 19 in the coil 16 of the alternating magnetic field producing means 31, magnetic field is imparted to the electroconductive layer 1 of the fixing film 15 at the fixing nip N and the electroconductive layer 26 of the pressing roller 20 thereat, and therefore, in the electroconductive layer 26 and in the electroconductive layer 1, the eddy current is produced to generate heat which heats the fixing nip N. By feeding the transfer material P through the fixing nip N more particularly between the fixing film 15 and the pressing roller 20, the unfixed toner image is heated and fixed on the transfer material P. At this time, the unfixed toner image is contacted to the fixing film 15.

By effecting the magnetic induction heating and fixing with such a structure, the rear surface of the transfer material P is heated simultaneously by the single alternating magnetic field producing means; thermal capacity is small, so that the time required for the heat conduction is short, and therefore, the rising time can be significantly reduced.

The heating principle in such a fixing nip N will be described referring to FIG. 4.

The magnetic flux produced by the current applied to the coil 18 by the excitation circuit 19 is introduced to the high magnetic permeability core 17 to generate the magnetic flux 23 and the eddy current 24 in the electroconductive layer 1 of the fixing film 15 in the fixing nip N. The heat is produced by the eddy current 24 and the specific resistance of the electroconductive layer 1.

Adjacent the surface of the pressing roller 20, the eddy current is produced in the electroconductive layer 26 by the magnetic flux in the electroconductive layer 26 of metal or the like to produce heat to enable back side heating of the transfer material P. The toner T is fused by the top and bottom heat, and then it is cooled into a permanent fixed image.

The metal film 1 of the fixing film 15 may be of non-magnetic metal, but preferably, it is of metal such as nickel, iron, magnetic stainless steel or the like exhibiting high absorption of the magnetic flux. The thickness is preferably not more than 200 $\mu$m. Preferably, it does not exceed the skin depth expressed by the following mathematical expression. If this skin depth is exceeded, the energy supplied to the pressing roller 20 is small.

The skin depth σ(m) is expressed by a frequency f(Hz) of the excitation circuit magnetic permeability $\mu$m, and a specific resistance β(Ohm.m) as follows:

$$\sigma=503\times(\beta/f\mu)^{1/2}$$

This means a depth of absorption of the electromagnetic radiation used for electromagnetic induction. By satisfying it, the strength of the electromagnetic radiation is not more than 1/e in a deep position, in other words, most of the energy is absorbed to this depth.

On the other hand, if it exceeds 200 $\mu$m, the hardness of the metal is remarkable with the result of difficulty in driving the film. Thermal capacity also increases with the result that it is not possible to rapidly raise the temperature from the room temperature to the fixable temperature in several sec.

The heat resistive resin material layer 2*a* at the outer part of the fixing film 15, is of a material having a thickness of 5 $\mu$m–25 $\mu$m and exhibiting a high parting property.

If the thickness is larger than 25 $\mu$m, the heat conduction is deteriorated, and the strength of the coating decreases, and in addition, the problem of requiring more than one step, and the advantage of the increased thickness is small.

On the other hand, if it is lower than 5 $\mu$m, a portion having poor parting property occurs due to non-uniformity in the coating, or the durability is not enough.

The heat resistive resin material layer 2*b* at the inside of the fixing film 15, is preferably, not less than 10 $\mu$m and not more than 1 mm. If it is smaller than 10 $\mu$m, the heat insulation is not enough, and the durability not enough, either. If it exceeds 1 mm, the metal film layer 1 is remote from the high magnetic permeability core 17 with the result of insufficient absorption of the magnetic flux by the metal film layer 1.

As to the electroconductive layer 26 as the heat generation layer of the pressing roller 20, the material is preferably nickel, iron, stainless steel or the like, which has a high magnetic permeability and a low resistance. When the use is made with a metal film, the thickness is preferably not more than 100 $\mu$m to provide sufficient elasticity of the pressing roller 20, and is preferably larger than the skin thickness.

It is further preferable that a sum of the thickness of the electroconductive layer 1 of the fixing film 15 and the thickness of the electroconductive layer 26 of the pressing roller 20 is larger than the skin thickness and not more than the skin thickness of the fixing film 15. This will be understood from the feature relating to the absorption of the electromagnetic radiation as described hereinbefore. The actual thicknesses of the electroconductive layers 1 and 26 are determined on the basis of the frequency of the excitation circuit 19 and the resistance of the electroconductive layer and magnetic permeability thereof, after the necessary heating value is determined. In this case, the materials of the electroconductive layers 1 and 26 are not necessarily the same.

Thus, the heat is generated directly by the metal film 1 close to the recording material P, and the heat can be transmitted to the recording material P through the thin parting resin material layer 2*a*, and the heat insulation is provided by the resin material layer 2*b* against the inward transfer of the heat generated by the metal film 1, so that remarkably high efficiency of the fixing device as compared with the conventional heat roller heating and fixing type or another type using a film, can be provided.

In the foregoing description, the film 15 is cylindrical, but it may be a take-up type (non-endless film). The material of the base material may not be a metal film 1, but it may be of a resin material film such as a polyimide exhibiting a heat-resistive and a mechanical strength and a resin material layer in which metal filler or the like is added to provide the electroconductive layer which generates heat. The same applies to an electroconductive layer 26 of the pressing roller 20, and electroconductive filler may be added into the rubber layer adjacent the Table layer in place of the metal layer.

EXAMPLE 1

The electroconductive layer 1 of the fixing film 15 was of a nickel electro-formed sleeve having an inner diameter of 24 mm, a thickness of 30 microns and a length of 230 mm.

As the pressing roller 20, a silicone rubber layer having a length of 230 mm and a layer thickness of 2 mm as the heat resistive elastic layer 25 was provided on a core metal 32 having an outer diameter of 16 mm. Thereon, a nickel film layer of 30 micron thick was provided as the electroconductive layer 26. Further thereon, a coating layer of PFA/PTFE is provided as the heat resistive resin material layer 27.

Seven ferrite cores 17 each having a length of 30 mm, a height of 10 mm and a width of 4 mm were arranged along the length. The total length thereof was 210 mm, and coil 18 was wound 15 times.

To the coil 18, a DC voltage of 140 V was applied at the period of 250 kHz with 50% of ON-duty.

With this structure, the fixing film 15 was heated up to 150° C. in 15 sec approx., and the temperature of the surface of the pressing roller 20 at this time was 100° C. so that color toner image could be sufficiently fixed.

COMPARISON EXAMPLE

As the electroconductive layer 1 of the fixing film 15, the use was made with a nickel electro-formed sleeve having an inner diameter of 24 mm, a thickness of 100 micron and a length of 230 mm.

As the pressing roller 20, a silicone rubber layer having a layer thickness of 2 mm and a length of 230 mm was provided on a core metal 32 having an outer diameter of 16 mm as a heat resistive elastic layer 25. Thereon, a nickel film layer of a 30 micron thick was provided as the electroconductive layer 26. Further thereon, a coating layer of PFA/PTFE was provided as the heat resistive resin material layer 27.

Seven ferrite cares 17 each having a length of 30 mm, a height of 10 mm and a width of 4 mm were arranged along the length. The total length thereof was 210 mm, and coil 18 was wound 15 times.

To the coil 18, a DC voltage of 140 V was applied at the frequency of 250 Khz with 50% of ON-duty.

With this structure, the fixing film 15 was heated up to 150° C. in 15 sec approx., and the temperature of the surface of the pressing roller 20 at this time was lower than 80° C. so that color toner image could not be sufficiently fixed.

As will be understood, the thickness of the electroconductive layer of the fixing film is preferably smaller than 100

μm from the standpoint of the surface temperature of the pressing roller.

COMPARISON EXAMPLE 2

A nickel electro-formed sleeve having an inner diameter of 24 mm, a thickness of 10 micron and a length of 230 mm.

As the pressing roller 20, a silicone rubber layer having a layer thickness of 2 mm and a length of 230 mm was provided on a core metal 32 having an outer diameter of 16 mm as a heat resistive elastic layer 25. Thereon, a nickel film layer of a 100 microns thick was provided as the electroconductive layer 26. Further thereon, a coating layer of PFA/PTFE was provided as the heat resistive resin material layer 27.

Seven ferrite cores 17 each having a length of 30 mm, a height of 10 mm and a width of 4 mm were arranged along the length. The total length thereof was 210 mm, and coil 18 was wound 15 times.

To the coil 18, a DC voltage of 140 V was applied at the period of 250 Khz with 50% of ON-duty.

With this structure, the fixing film 15 was heated up to 150° C. in 15 sec approx., and the temperature of the surface of the pressing roller 20 at this time was also approx. 150° C. so that color toner image could be sufficiently fixed at the leading edge of the transfer material P, but at the trailing end portions, the temperature lowers to 100° C., and the fixing is not effected.

Therefore, from the standpoint of the surface temperature of the fixing film, the thickness of the electroconductive layer of the fixing film is preferably larger than 10 μm.

Thus, in this embodiment, use is made with the film having the electroconductive layer, the pressing member having the electroconductive layer and the alternating magnetic field producing means for generating heat by eddy current by imparting magnetic field to the electroconductive layers, wherein the recording material is passed through the nip between the film and the pressing member so that the heating is effected both in the film and the pressing member in the recording material heating portion, thus permitting quick start feature (the temperature rises to a predetermined temperature in a short time).

When the present intention is employed in a heat-fixing device for color images, the heat quantity in the fixing nip is sufficient to assure the fixing property of the color toner image because of the sufficient heating.

The description will be made as to an embodiment wherein the unfixed toner images are fixed of both sides of the recording material.

EMBODIMENT 2

From the standpoint of source saving, the demand for a recording device capable of forming images on both sides (duplex recording) is increasing.

Figure 5:
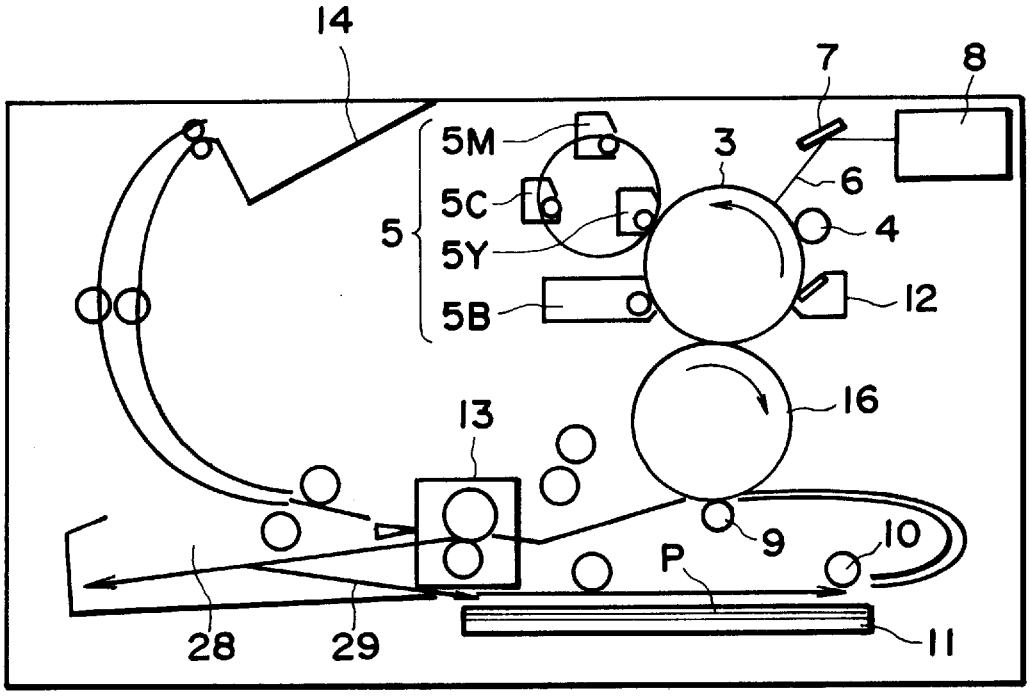
FIG. 5 is a schematic illustration of an image forming apparatus according to embodiment 2 of the present invention.

FIG. 5 is a schematic illustration of an example of an image forming apparatus capable of duplex recording. The image forming apparatus of this embodiment is an electrophotographic color printer of laser scanning type. The formation mechanism for a full-color toner image on the intermediate transfer drum 16 is the same as in FIG. 1, and therefore, detailed description is omitted for simplicity.

In the duplex printing mode, a full-color toner image for the first side is formed on the intermediate transfer material drum 16, and is transferred onto the recording material fed from a sheet feeding cassette 11 by a transfer roller 9. The transfer material P is separated from the transfer drum 16 and is introduced into the fixing device 13, so that the transfer toner image is fixed on the first side.

The transfer material P having the fixed toner image on the first side, having been discharged from the fixing device 13, is once received face-up on a reversion tray 28.

Then, formation of a full-color toner image for the second side is carried out, and the image is transferred onto the intermediate transfer drum 16. The transfer material on the reversion tray 28 is fed to the transfer portion through a path 29, upper portion of the sheet feeding cassette 11 and a sheet feeding roller 10. The second full-color toner image is transferred onto a second side (opposite from the first side having the image) of the transfer material from the intermediate transfer drum 16.

The transfer material now having the toner image on the second side, is introduced again into the fixing device 13 where the transfer toner image is fixed on the second side, and the transfer material is discharging onto the sheet discharge tray 14.

The structure of the fixing device 13 is the same as that of the device shown in FIG. 2–FIG. 4.

In the duplex mode, when the fixing film 15 for the second side and the pressing roller 20 for the first side produces same amounts of heat during the fixing operation for the second side, the already fixed first side image may be fused again with the result of image disturbance. Additionally, the pressing roller 20 may be contaminated, and the back side contamination of the transfer material may occur. In such a case, it is desirable that the fixing film 15 and the pressing roller 20 produce different amounts of heat. For example, the heating value of the pressing roller 20 is made smaller than the heating value of the fixing film 15, by which heat supply beyond necessity is suppressed, and the disturbance of the first side image, the pressing roller contamination and the back side contamination of the transfer material can be avoided.

In the magnetic induction heating and fixing, the ratio of the supply electric power to the electroconductive layer 1 of the fixing film 15 side and the supply electric power to the electroconductive layer 26 of the pressing roller 20 side can be changed by varying the frequency depending on whether the image is to be fixed on the first side or the second side, in the duplex mode. The ratio is such that the heat generation at the pressing roller 20 side is stronger upon the fixing on the first side to suppress the curl of the recording material by making thermal-expansions at both sides substantially the same, and that the heat generation at the pressing roller 20 side is weaker to prevent toner offset due to the refusing of the toner image on the first side. As compared with the conventional heat roller type fixing device, the responsivity is high, and thermal capacity is not used to fix the image so that the temperature adjustment at the pressing roller side can be easily carried out, and therefore, the present invention is particularly suitable for duplex recording. Additionally, with the magnetic induction heating and fixing, the both side heating is possible with a single one heating means (magnetic flux producing means), and the heat generation adjustment of the pressing member is easy.

Figure 6:
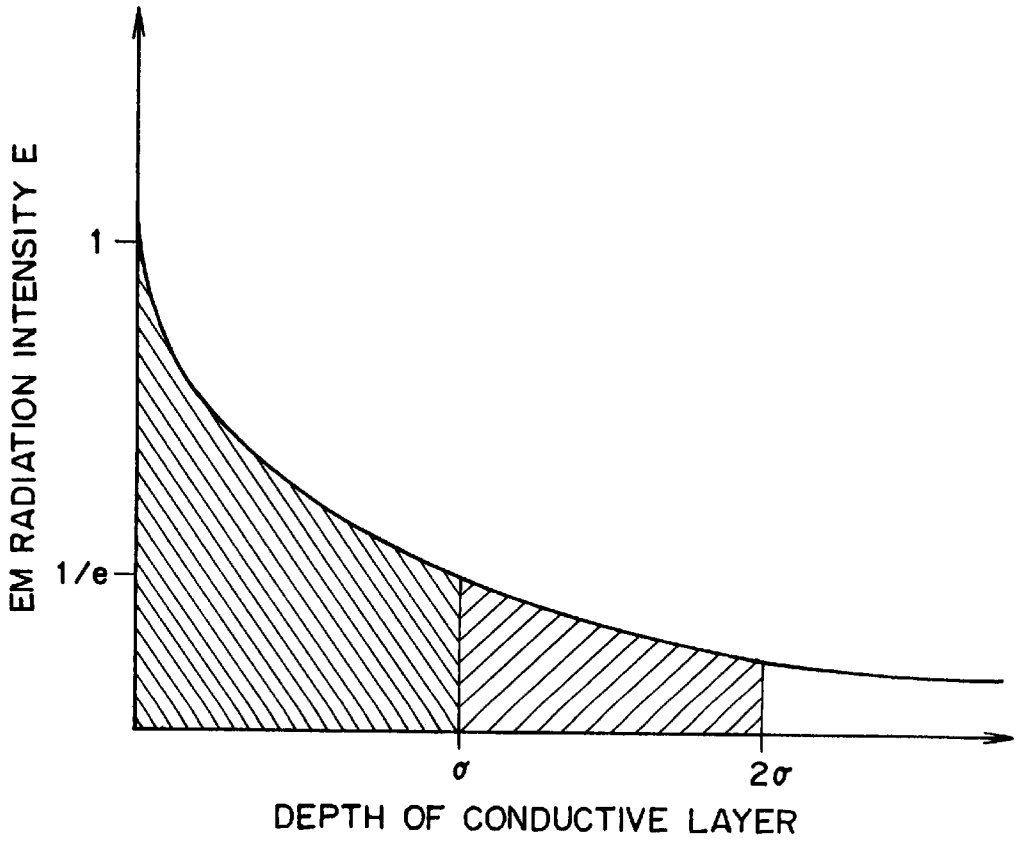
FIG. 6 is a graph of absorption factor of an electromagnetic radiation relative to a thickness of the electroconductive layer.

The heat generation energy of the electroconductive layers 1 and 26 of the fixing film 15 and the pressing roller 20, is distributed as shown in FIG. 6. In this Figure, the abscissa represents the thickness of the electroconductive layer and the ordinate represents the intensity of the electromagnetic radiation. As described hereinbefore, the electromagnetic radiation is absorbed by the skin depth σ to attenuation to 1/e. The intensity of the energy of the electromagnetic radiation is proportional to 2 ride of the intensity, and the energy P absorbed from the excitation coil surface to the depth σ, is expressed as follows:

$$\Gamma = \int_0^{\sigma} E^2 dx = A \int_0^{\sigma} e^{-\frac{2x}{\sigma}} dx = -A \frac{\sigma}{2} \left[ e^{-\frac{2x}{\sigma}} - 1 \right]_0^{\sigma}$$

"A" is a constant. As will be understood from the mathematical expression, 86.4% of the energy is absorbed until the skin depth σ is reached, and when the depth is 0.5 σ, 63.2% is absorbed, and 98.2% is absorbed until 2 σ is reached.

Therefore, the same material is used for the electroconductive layers land 26 of the fixing film 15 and the pressing roller 20, and the skin depth 0.5 σ for a frequency is used, the ratio of the absorbed energies of the fixing film 15 and the pressing roller 20, are:

63.2: (86.4−63.2)=63.2: 23.2

After the first side is fixed with this, the frequency is made 4 f when the second side is to be fixed. By this, the skin depth σ of the frequency is ½ of the original σ.

As a result, the ratio of the absorbed energies of the fixing film 15 and the pressing roller 20 is:

86.4: (98.2−86.4)=86.4: 11.8.

Thus, the heat generation at the pressing roller 20 side is weaker in the heating for the second side than the heating for the first side of the recording material.

EXAMPLE

In the duplex printing mode, for the heating and fixing of the toner image for the first side of the recording material, both of the fixing film 15 and the pressing roller 20 are energized to heat both sides of the recording material. In this case, the electroconductive layer 1 of the fixing film 15 is of Ni, and the electroconductive layer 26 of the pressing roller 20 is of Ni, too, as in the foregoing example. The same thickness of 50 μm is used for both. When 100 kHz is applied, the heating values of the fixing film 15 and the pressing roller 20 are substantially 3:1.

When the toner image is fixed on the second side, the frequency is changed to 400 kHz with the same structure. The ratio is 8:1. Thus, the heat generation is stronger at the fixing film 15 side to which the second side of the recording material is contacted, so that the normal fixing is effected. The pressing roller 20 side does not produce large amount of heat, and therefore, the toner image on the first side to which the pressing roller 20 is contacted is not re-fused, thus preventing toner offset.

In this example, the electroconductive layers 1 and 26 of the fixing film 15 and the pressing roller 20 were of the same material and had the same thicknesses. But, the material and/or the thickness may be different.

Figure 7:
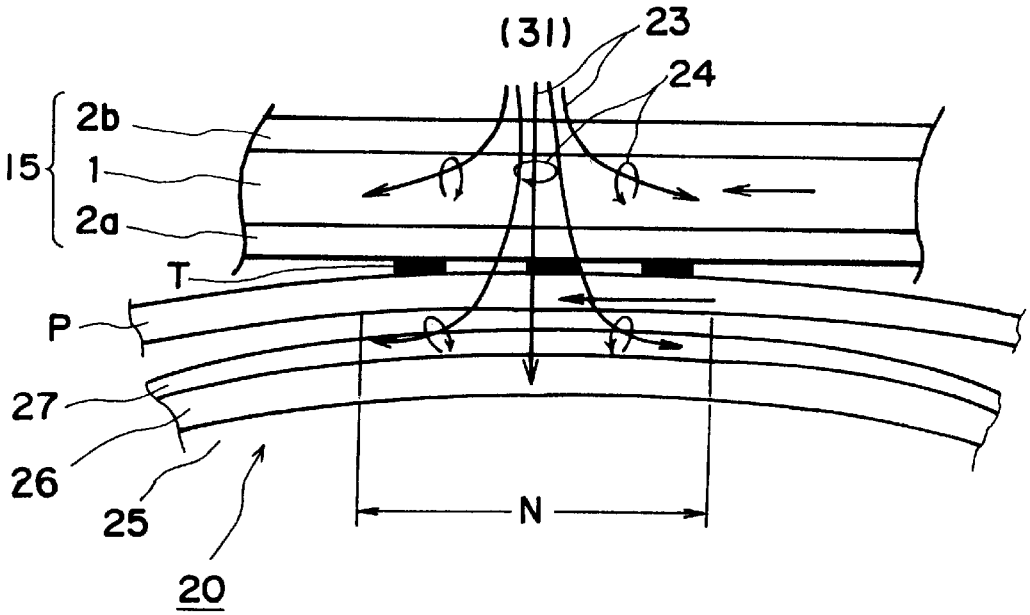
FIG. 7 is an illustration of a heating principle in another embodiment.

FIG. 7 shows such an example. Normally, the electroconductive layer 26 of the pressing roller 20 side absorbs the rest of the energy after being absorbed by the electroconductive layer 1 of the fixing film 15, Preferably, the skin depth of the electroconductive layer 26 of the pressing roller 20 side is smaller than that of the electroconductive layer 1 of the fixing film 15 by selection of the materials.

The total energy amount to be supplied to each of the electroconductive layers 1 and 26 of the fixing film 15 and the pressing roller 20 is adjusted by changing the ON and OFF duties to be supplied to the coil 18.

The duplex recording type is not limited to the color printer but is usable with a monochromatic printer.

According to this embodiment, when the toner image is fixed on the first side, the heating is effected by both of the film side and the pressing roller side, so that the curl is reduced. By this, improper transportation of the recording material for the second Side recording, occurrences of creases and corner folding of the recording material can be avoided. When the toner image is to be fired on the second side, the heating at the pressing member side is reduced to prevent the toner offset to the pressing member.

Even in a simplex recording (only on one side), the temperature of the pressing roller 20 rises with the result of increase of the heat supply from the pressing roller 20 to the recording material P. Therefore, when the temperature of the pressing roller 20 rises, the relation in the heating value between the fixing film 15 and the pressing roller 20 is gradually changed to prevent excessive temperature rise of the pressing roller 20. This is preferable.

The degree of the temperature rise of the pressing roller 20 can be predicted on the basis of the time period of continuous print and the sheet feeding time during that. So, on the basis of the time data, the frequency may be changed to change the ratio of the heating value between the pressing roller 20 and the fixing film 15. Or, the temperature of the pressing roller 20 may be directly detected, and on the basis of the detection, the ratio of the heating value may be changed.

By doing so, the heat supply amount to the recording material P from the fixing film 15 side and the heat supply amount from the pressing roller 20 to the recording material P are always constant so that the curl amount of the recording material does not change, thus stabilizing the stacking on the sheet discharge tray 14.

Also, when color images and monochromatic images are alternately recorded, the both side heating is effected by the fixing film 15 and the pressing roller 20 in the Color images which have thickness toner images, and when the monochromatic images are printed on one side, the heating is effected only by the fixing film. This is possible only by changing the frequency applied to the coil 18.

Figure 8:
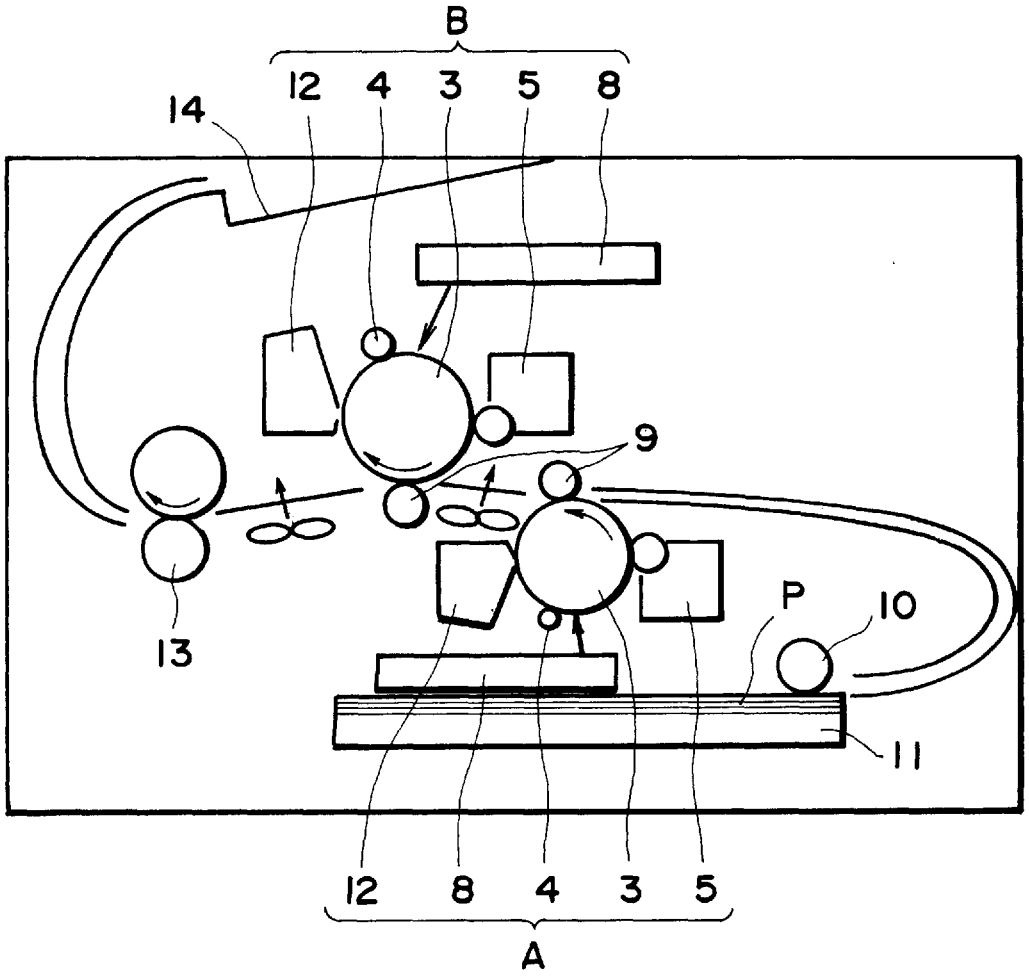
FIG. 8 is a schematic illustration of an image forming apparatus according to a further embodiment.

FIG. 8 show an example of a duplex image recording device of single path type. This image recording device is usable for color recording and for monochromatic recording.

In the single path type, the toner images are given to the first and second sides simultaneously or with short time difference. This type is simple and the size of the apparatus is small. Furthermore, duplex recording is possible in a short time. In this case, if the first and second sides are fixed by top and bottom rollers, the apparatus is bulky, and the responsivity is not good, as has been described in embodiment 2. However, by the use of magnetic induction heating and fixing, the efficiency is improved, and the device structure is simplified.

In the image recording device of simultaneous single path type of FIG. 8, the transfer material P as the recording material fed out by the sheet feeding roller 10 from the sheet feeding cassette 11, is introduced into the transfer portion formed between the photosensitive drum 3 and the transfer roller 9 of the first image formation mechanism A. The transfer roller 9 supplies the charge of the opposite polarity from the toner to the rear surface of the transfer material to transfer the toner image from the photosensitive drum 3 to the first surface of the transfer material.

The transfer material is introduced into a transfer portion formed between the photosensitive drum 3 and the transfer roller 9 of the second image formation mechanism B to transfer the toner image onto the second surface of the transfer material.

The transfer material sequentially having received the toner images on the first and second sides thereof by the first and second image formation mechanisms A and B, is fed to the fixing device 13 where the toner images are fixed on the first and second sides by heating and fixing, and then is discharged onto the sheet discharge tray 14.

The structure of the fixing device 13 is similar to the device of above described FIG. 2–FIG. 4. In this fixing device 13, both of the fixing film 15 and the pressing roller 20 are energized to raise the temperatures to the fixing temperature, or only the fixing temperature is energizes if desired to fix the unfixed toner image on the transfer material.

In the foregoing embodiments, the heating devices have been image heat-fixing devices. But, the present invention is not limited to them, and is usable with a device for heating the recording material bearing an image to improve the surf ace property (gloss or the like), with a device for temporary fixing, or another device for heating of the material to be heated such as sheet-like (sheet).

While the invention has been described with reference to the structures disclosed herein, it is not confined to the details set forth and this application is intended to cover such modifications or changes as may come within the purpose of the improvements or the scope of the following claims.

What is claimed is:

1. An image heating apparatus comprising:

a movable member having an electroconductive portion;

a back-up member for forming a nip with said movable member;

wherein said back-up member has an electroconductive portion adjacent a surface thereof;

magnetic flux generating means for generating a magnetic flux;

wherein eddy current is generated in said movable member and said back-up member by a magnetic flux generated by said magnetic flux generating means, and said movable member and said back-up member generate heat by the eddy current.

2. An apparatus according to claim 1, wherein said back-up member is in the form of a roller.

3. An apparatus according to claim 2, wherein said roller has an elastic layer, and the electroconductive portion of said roller is an electroconductive layer which is provided outside said elastic layer.

4. An apparatus according to claim 3, wherein said electroconductive layer has a thickness which is not more than 100 $\mu$m.

5. An apparatus according to claim 3, wherein said roller has a parting layer outside said electroconductive layer.

6. An apparatus according, to claim 2, wherein the electroconductive portion of said roller includes electroconductive filler material mixed into said roller.

7. An apparatus according to claim 1, wherein said magnetic flux generating means is disposed across said movable member from said back-up member.

8. An apparatus according to claim 7, the magnetic flux generated by said magnetic flux generating means is passed through said movable member and reaches the back-up member.

9. An apparatus according to claim 1, wherein said movable member is a film.

10. An apparatus according to claim 1, wherein a recording material carrying an unfixed toner image is passed through said nip by which the unfixed toner image is fixed on the recording material.

11. An apparatus according to claim 10, wherein the unfixed toner image includes layers of different color toners that are mixed to form a full-color image upon image fixing.

12. An apparatus according to claim 10, wherein after the unfixed toner image is fixed on a first side of the recording material, an unfixed toner image is fixed on a second side of the recording material.

13. An apparatus according to claim 12, wherein the unfixed toner image is contacted to said movable member, and a temperature of said back-up member is higher when fixing the first side than when fixing the second side.

14. An image heating apparatus comprising:

a movable member contactable with an unfixed toner image while it is moved;

a back-up member for forming a nip with said movable member;

wherein said back-up member has an electroconductive portion adjacent the surface thereof;

magnetic flux generating means for generating magnetic flux;

wherein eddy current is generated in said back-up member by a magnetic flux generated by said magnetic flux generating means, and said back-up member generates heat by the eddy current.

15. An apparatus according to claim 14, wherein said back-up member is in the form of a roller.

16. An apparatus according to claim 14, wherein said roller has an elastic layer, and the electroconductive portion of said roller is an electroconductive layer which is provided outside said elastic layer.

17. An apparatus according to claim 16, wherein said electroconductive layer has a thickness which is not more than 100 $\mu$m.

18. An apparatus according to claim 16, wherein said roller has a parting layer outside said electroconductive layer.

19. An apparatus according to claim 15, wherein the electroconductive portion of said roller includes electroconductive filler material mixed into said roller.

20. An apparatus according to claim 14, wherein said magnetic flux generating means is disposed across said movable member from said back-up member.

21. An apparatus according to claim 20, wherein the magnetic flux generated by said magnetic flux generating means is passed through said movable member and reaches the back-up member.

22. An apparatus according to claim 14, wherein said movable member is a film.

23. An apparatus according to claim 14, wherein a recording material carrying an unfixed toner image is passed through said nip by which the unfixed toner image is fixed on the recording material.

24. An apparatus according to claim 23, wherein the unfixed toner image includes layers of different color toners that are mixed to form a full-color image upon image fixing.

25. An apparatus according to claim 23, wherein after the unfixed toner image is fixed on a first side of the recording material, an unfixed toner image is fixed on a second side of the recording material.

26. An apparatus according to claim 25, wherein a temperature of the back-up member is higher when fixing the first side than when fixing the second side.

27. An image heating apparatus comprising:

a movable member having an electroconductive portion:

a back-up member for forming a nip with said movable member;

wherein said back-up member has an electroconductive portion adjacent a surface thereof;

an excitation coil for generating a magnetic flux;

wherein said excitation coil is disposed across said movable member from said back-up member;

control means for controlling a voltage applied to said excitation coil.

28. An apparatus according to claim 27, wherein said control means controls a frequency of an applied voltage.

29. An apparatus according to claim 27, wherein after the unfixed toner image is fixed on a first side of the recording material, an unfixed toner image is fixed on a second side of the recording material.

30. An apparatus according to claim 29, wherein a frequency of a voltage applied to said excitation coil for a first side of the recording material is different from that applied for a second side of the recording material.

31. An apparatus according to claim 27, wherein a monochromatic toner image and a plural color image are both fixed in said nip.

32. An apparatus according to claim 31, wherein a frequency of the voltage applied to said excitation coil is different for a monochromatic mode than for chromatic mode.

* * * * *

UNITED STATES PATENT AND TRADEMARK OFFICE

CERTIFICATE OF CORRECTION

PATENT NO. : 5,862,445

DATED : January 19, 1999

INVENTOR(S) : KENICHI OGAWA, ET AL.

It is certified that error appears in the above-identified patent and that said Letters Patent is hereby corrected as shown below:

COLUMN 1,
Line 7, "currant" should read --current--;
Line 65, "ember" should read --member--; and
Line 66, "the the" should read --to the--.

COLUMN 2,
Line 5, "claim." should read --claims.--;
Line 28, "EMBODIMENT" should read --EMBODIMENTS--; and
Line 32, "mate" should read --image--.

COLUMN 3,
Line 4, "intermediated" should read --intermediate--; and
Line 67, "to" should be deleted.

COLUMN 4,
Line 34, "coil 16" should read --coil 18--.

COLUMN 5,
Line 38, "not" should read --is not--.

COLUMN 6,
Line 55, "cares" should read --cores--.

COLUMN 7,
Line 49, "of" should read --on--.

UNITED STATES PATENT AND TRADEMARK OFFICE

CERTIFICATE OF CORRECTION

PATENT NO. : 5,862,445

DATED : January 19, 1999

INVENTOR(S) : KENICHI OGAWA, ET AL.

It is certified that error appears in the above-identified patent and that said Letters Patent is hereby corrected as shown below:

COLUMN 9,
Line 6, "⌈=" should read --P=--.

COLUMN 10,
Line 13, "fired" should read --fixed--; and
Line 46, "show" should read --shows--.

COLUMN 11,
Line 17, "energizes" should read --energized--;
Line 23, "surf" should read --sur- --;
Line 24, "ace" should read --face--;
Line 39, thereof;" should read --thereof; and--; and
Line 58, "according," should read --according--.

COLUMN 12,
Line 23, "thereof;" should read --thereof; and--.

UNITED STATES PATENT AND TRADEMARK OFFICE

CERTIFICATE OF CORRECTION

PATENT NO. : 5,862,445

DATED : January 19, 1999

INVENTOR(S) : KENICHI OGAWA, ET AL.

It is certified that error appears in the above-identified patent and that said Letters Patent is hereby corrected as shown below:

COLUMN 13,
Line 2, "portion:" should read --portion;--; and
Line 9, "member;" should read --member; and--.

Signed and Sealed this

Twelfth Day of October, 1999

*Attest:*

Q. TODD DICKINSON

*Attesting Officer*

*Acting Commissioner of Patents and Trademarks*